US007267380B2

(12) United States Patent
Bullock et al.

(10) Patent No.: US 7,267,380 B2
(45) Date of Patent: Sep. 11, 2007

(54) ROTARY LATCH AND HOUSING

(75) Inventors: Charles Bullock, Waukegan, IL (US); William F. Laubach, Elk Grove Village, IL (US)

(73) Assignee: A.L. Hansen Manufacturing Co., Waukegan, IL (US)

( * ) Notice: Subject to any disclaimer, the term of this patent is extended or adjusted under 35 U.S.C. 154(b) by 140 days.

(21) Appl. No.: 10/987,222

(22) Filed: Nov. 12, 2004

(65) Prior Publication Data

US 2006/0103144 A1 May 18, 2006

(51) Int. Cl.
*E05B 9/00* (2006.01)

(52) U.S. Cl. ..... 292/337; 292/DIG. 64

(58) Field of Classification Search ..... 292/337, 292/DIG. 64

See application file for complete search history.

(56) References Cited

U.S. PATENT DOCUMENTS 2,454,145 A * 11/1948 Erkkila ..... 70/448
4,320,642 A 3/1982 Pastva, Jr.
4,896,906 A 1/1990 Weinerman et al.
5,069,491 A 12/1991 Weinerman et al.
5,439,260 A 8/1995 Weinerman et al.
5,445,422 A 8/1995 Weinerman et al.
5,564,295 A 10/1996 Weinerman et al.
5,577,782 A * 11/1996 Johnson et al. ..... 292/216
5,611,224 A 3/1997 Weinerman et al.
5,884,948 A 3/1999 Weinerman et al.
6,149,210 A * 11/2000 Hunt et al. ..... 292/216
6,158,787 A * 12/2000 Kutschat ..... 292/214
6,497,436 B1 * 12/2002 DeBlock et al. ..... 292/216
6,629,710 B1 * 10/2003 Shafry et al. ..... 292/216
6,974,163 B2 * 12/2005 Peng et al. ..... 292/1.5
2005/0057051 A1 * 3/2005 Bartos ..... 292/337

OTHER PUBLICATIONS

Eberhard® Hardware Manufacturing Ltd. "Slam Latches—Mini Rotary—240", http://www.eberhardcanada.com/toolbox/slam4.htm, Apr. 29, 2004, 1 page.
Eberhard® Hardware Manufacturing Ltd. "Slam Latches—Mini Rotary—240", http://www.eberhardcanada.com/toolbox/slam4drw.htm, Apr. 29, 2004, 1 page.

* cited by examiner

*Primary Examiner*—Gary Estremsky
(74) *Attorney, Agent, or Firm*—Brinks Hofer Gilson & Lione

(57) ABSTRACT

An improved rotary latch and housing configured to receive a strike is described. The housing includes two parts that are mated together to improve their resistance to impact forces imparted by the strike. The housing is provided with a channel-shaped recess for receiving the strike. A rotary jaw and rotary pawl are disposed within the housing to secure the strike in a locked position and release the strike in an unlocked position.

12 Claims, 4 Drawing Sheets

ROTARY LATCH AND HOUSING

TECHNICAL FIELD

The present invention relates to latches, and more particularly, to an improved rotary latch system.

BACKGROUND INFORMATION

Rotary latch systems have been used in various applications for many years. Rotary latches are particularly useful in applications where a user slams shut a door or lid. For example, rotary latches are frequently used in automobiles to secure lift gates, doors, hoods, and lids. Rotary latches are also used to secure cabinet doors to cabinets. In automotive applications, rotary latch systems must withstand relatively high impact forces. Moreover, lift gates, doors, hoods, and lids are opened and closed (often forcefully) countless times during the life of an automobile. As a result, rotary latch systems must be long-lasting and hard-wearing.

Typical rotary latches generally include a housing that contains a rotary pawl and a rotary jaw. The rotary jaw and housing include U-shaped notches for receiving a strike surface. In general, the pawl controls the jaw. Over the years, this type of latch has been improved numerous times and yet retains the same basic mechanism and function of original rotary latches.

One previously known, slam-capable rotary latch mechanism is described in U.S. Pat. No. 5,844,948 ("'948 patent") entitled ROTARY LATCH AND LOCK and U.S. Pat. No. 5,564,295 ("'295 patent") entitled HANDLE OPERABLE ROTARY LATCH AND LOCK. In general, these patents describe a rotary latch having a pair of housing side plates that sandwich the rotary jaw and rotary pawl. The '948 patent discloses housing side plates including formations extending toward a central plane (that is occupied by the rotary jaw and the rotary pawl) to guide and maintain proper positioning of one or both of the rotary jaw and the rotary pawl within the common central plane. Spacers are positioned transversely relative to the rotary jaw and rotary pawl. As described in the '948 patent, the spacers are immovably attached to the housing side plates through hexagonal holes in the housing side plates. Additionally, one of the housing side plates is provided with an integrally formed reinforcement flange adjacent the strike-receiving portion of the housing side plate.

Previously known slam-capable rotary latches, however, have a number of drawbacks. Many previously known rotary latches are subjected to relatively high shear forces generated as the strike slams into the latch and housing. Over time, the housing, rotary jaw and rotary paw fatigue and may jam or come apart, thus rendering the latch inoperable. While reinforcement flanges have been previously used to reinforce housing side plates, such flanges are not interconnected. As a result, such flanges provide limited support. In addition, manufacturing previously known slam-capable rotary latches can be unnecessarily difficult and time-consuming.

BRIEF SUMMARY

The various preferred embodiments provide significant improvements and advantages over other rotary latches. According to a first aspect of the present invention, a rotary latch includes a housing having a first lateral wall and a first transverse wall extending from the lateral wall. The first transverse wall has a first projection. The housing further includes a second lateral wall, and a second transverse wall extending from the second lateral wall. The second transverse wall forms a recess adapted to receive the first projection. In various embodiments, the projection and recess can be configured as a tab and slot fitting or a dovetail fitting, for example and without limitation. In one embodiment the projection and recess are welded or secured together by an adhesive. The first lateral wall and the second lateral wall further define a channel configured to receive a strike.

The foregoing paragraph has been provided by way of general introduction, and is not intended to limit the scope of the following claims. The presently preferred embodiments, together with further advantages will be best understood by reference to the following detailed description taken in conjunction with the accompanying drawings.

BRIEF DESCRIPTION OF THE DRAWINGS

Embodiments of the present invention will now be described by way of example with reference to the accompanying drawings, in which.

DETAILED DESCRIPTION OF THE PREFERRED EMBODIMENTS

Figure 1:
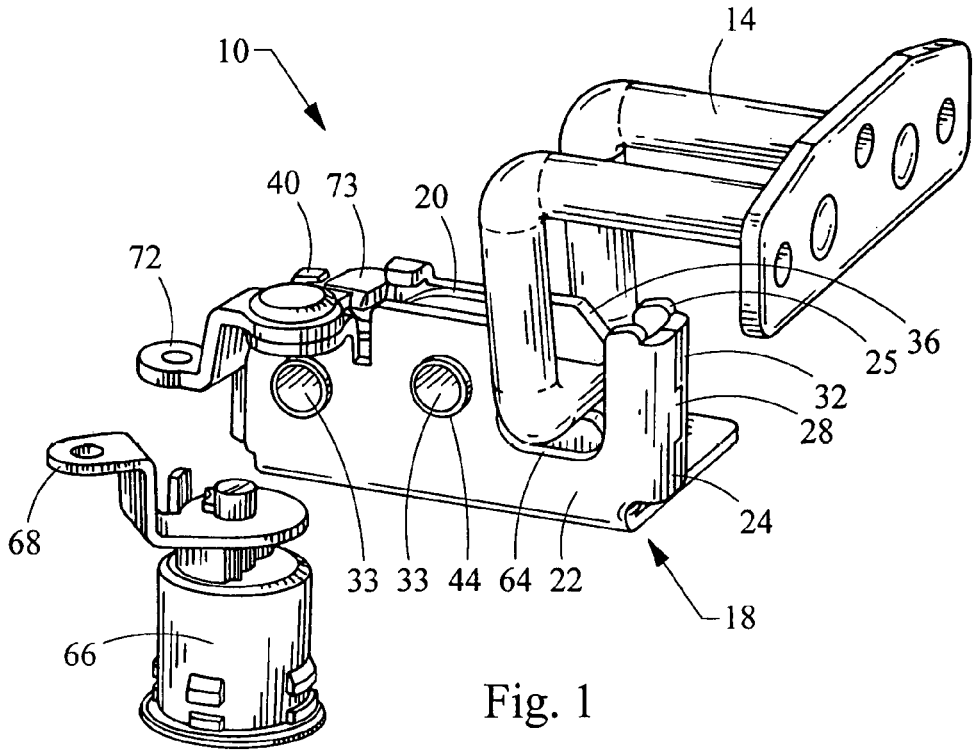
FIG. 1 illustrates a perspective side view of an exemplary rotary latch having a mated housing.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings. It should also be understood that the drawings are not to scale and in certain instances details have been omitted, which are not necessary for an understanding of the present invention, such as conventional details of fabrication and assembly.

Referring to the drawings, FIGS. 1-5 illustrate an embodiment of the present invention, and in particular, a rotary latch 10. Generally, rotary latch 10 includes a mated housing 18, a latch mechanism 20, and a control assembly 65. Housing 18 is formed from two mated covers. Latch mechanism 20 is partly enclosed within housing 18. Latch mechanism 20 generally includes a rotary jaw 36, a rotary pawl 40, sleeves 44, 48, and a return spring 52. The latch mechanism and the housing are adapted to receive and secure (or latch) strike 14. Rotary latch 10 has an open position and a closed position. In the open position, the jaw is positioned to receive the strike and to rotate into a closed position. In the closed position, the strike is secured by the jaw and the housing. A control assembly generally includes a conventional key lock and a control linkage. The control assembly allows a user to open the latch.

Figure 2:
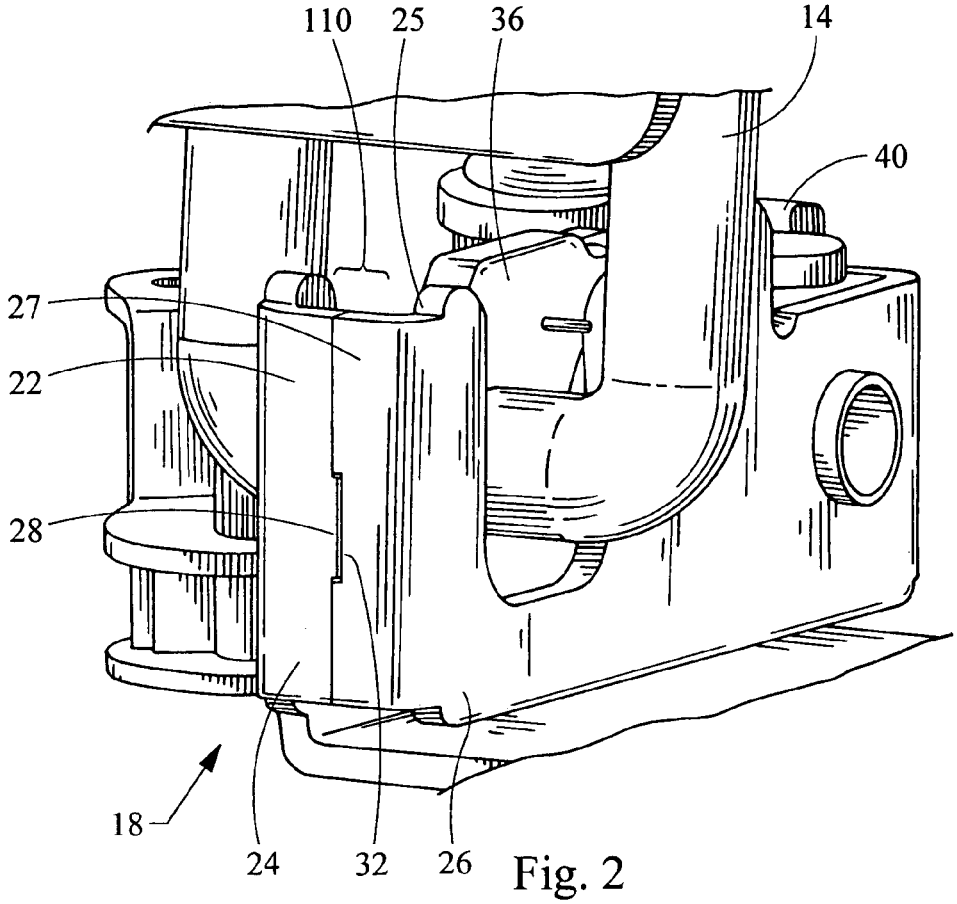
FIG. 2 illustrates a perspective front view of an exemplary rotary latch having a mated housing.
Figure 3:
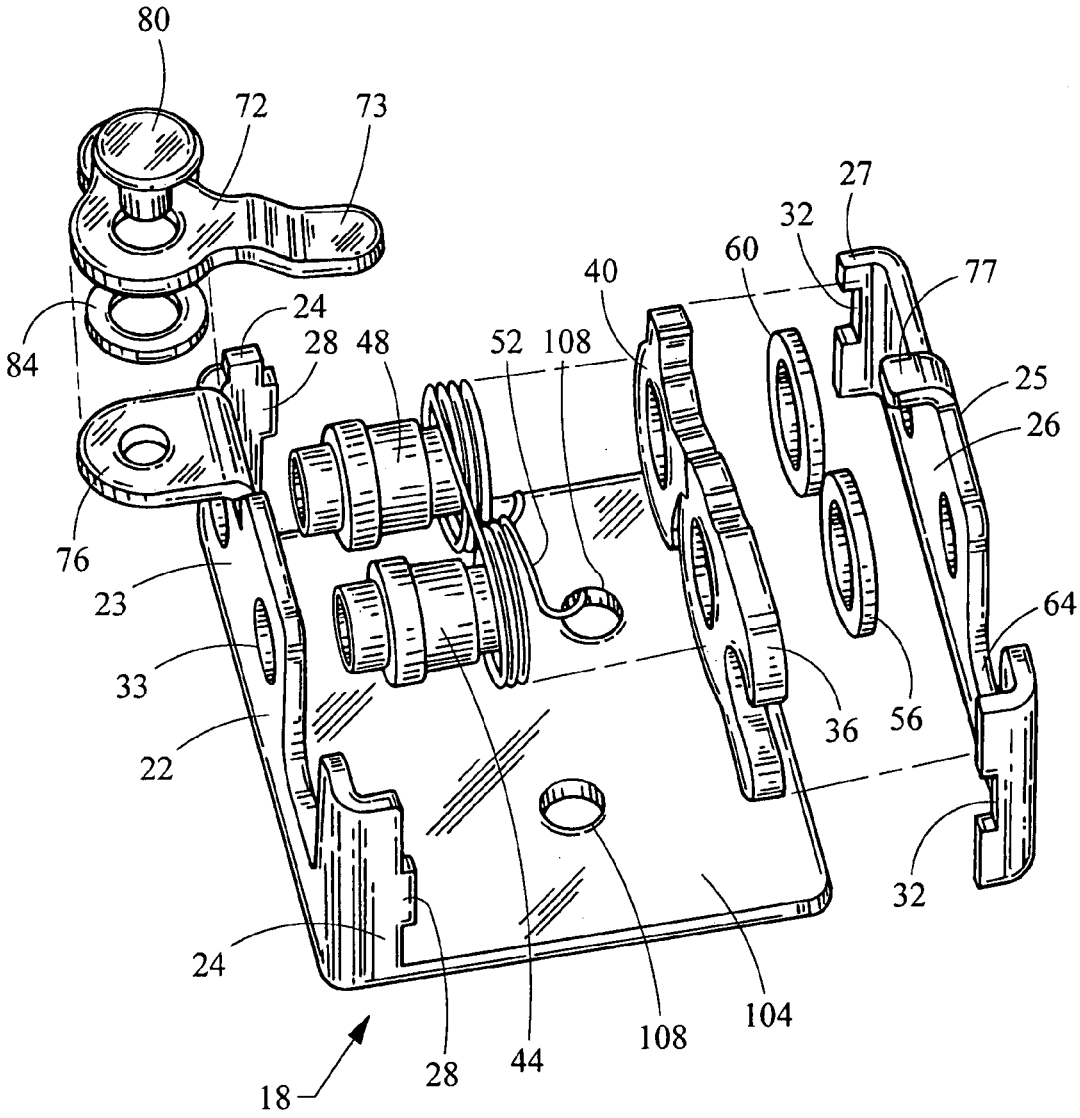
FIG. 3 illustrates a partially exploded top view of an exemplary rotary latch having a mated housing.

As best shown in FIGS. 1-3, housing 18 is formed from covers 22 and 25. In particular, as illustrated in FIG. 2, cover 22 includes lateral wall 23 and transverse walls 24. Likewise, cover 25 has a lateral wall 26 and transverse walls 27 that extend from lateral wall 26. Accordingly, each transverse wall extends only part way across the distance between walls 23 and 24, and is joined about a central region 110 (FIG. 2) by a tab and slot configuration.

The disclosed tab and slot configuration reinforces the housing, which is subjected to a variety of impact forces created as the strike slams into the latch. Transverse walls 24 include tabs 28 and transverse walls 27 of cover 25 are provided with slots 32. As illustrated in FIG. 2, slots 32 are configured to mate with tabs 28. As will be apparent to one of ordinary skill, the position of the slots and tabs can be switched, so that cover 22 has slots 32 and cover 25 has tabs 28. The slots and tabs can alternatively be positioned at any point along the edge of the transverse walls. In another alternative embodiment, a dovetail configuration can be used rather than slots and tabs. A dovetail configuration prevents the covers from laterally separating along axis Z of FIG. 1 once the covers are assembled. Multiple sets of tabs and slots or dovetail configurations can be provided on the transverse walls to further provide further reinforcement. In another embodiment, the transverse walls can be alternatively joined by an adhesive or by welding, rather than providing slots and tabs. In this configuration, housing 18 is formed from a unitary construction, rather than from two separate covers. As such, the housing is provided with unitary transverse walls that form bridging elements between lateral walls.

As illustrated in FIG. 3, covers 22 and 25 both include strike channels 64. Strike channels 64 have a relatively flat, squared lower surface that, depending on the shape of the strike, may receive the impact from strike 14. Openings 33 are provided to receive sleeves 44 and 48, which are discussed in greater detail below. Cover 22 further includes a floor 104 having openings 108. When used in automotive applications, openings 108 are used to attach the housing to the body of the automobile. In addition, covers 22 and 25 are provided with flanges 76 and 77, respectively, as best illustrated in FIG. 3.

Figure 4:
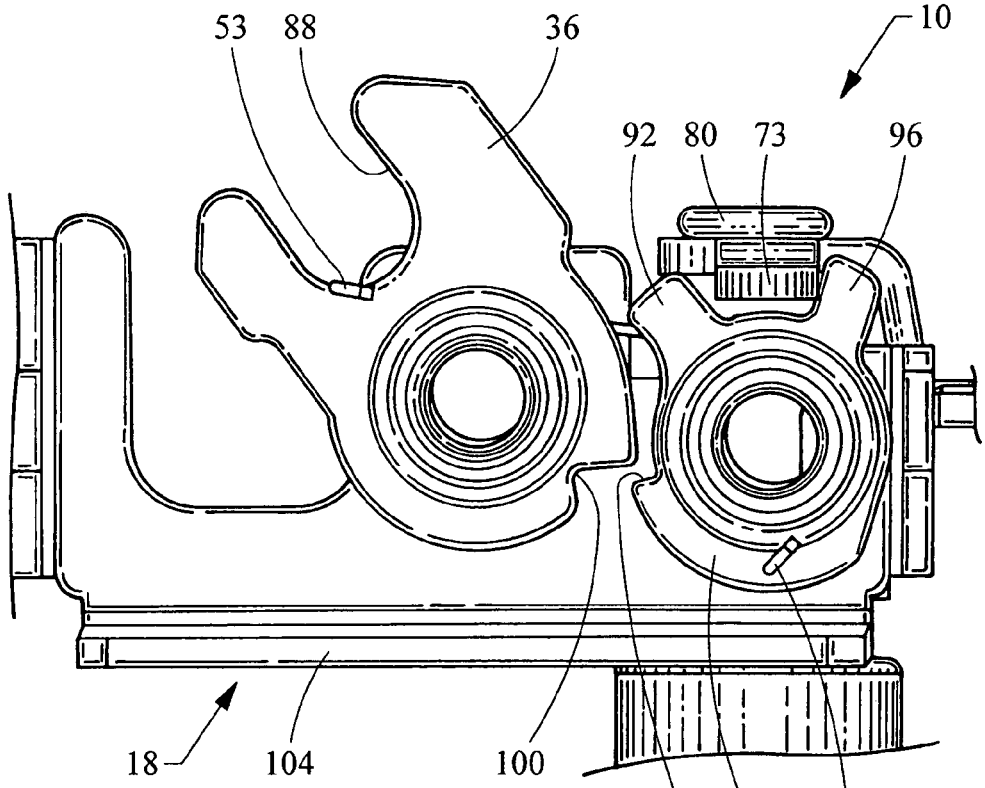
FIG. 4 illustrates a cross-section of an exemplary rotary latch in an open position.
Figure 5:
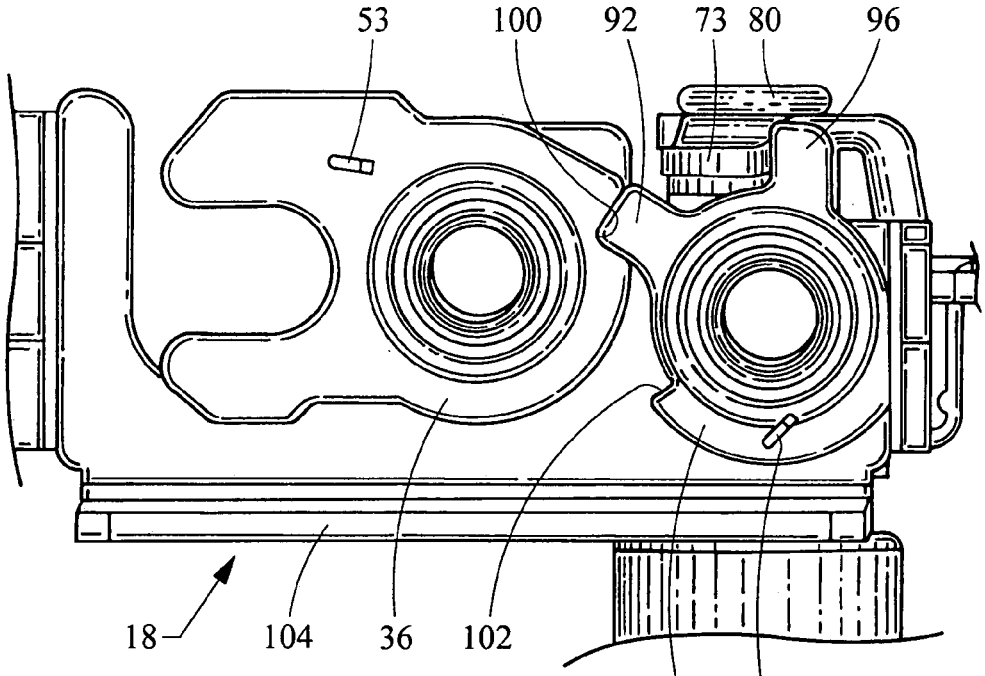
FIG. 5 illustrates a cross-section of an exemplary rotary latch in a closed position.

Referring to FIG. 1, housing 18 partly contains latch mechanism 20. As further shown in FIG. 3, latch mechanism 20 generally includes a rotary jaw 36, a rotary pawl 40, sleeves 44, 48, and a return spring 52. Referring to FIGS. 4-5, housed between covers 22 and 25 are the jaw 36 and pawl 40. Jaw 36 and pawl 40 are received over sleeves 44 and 48, respectively, in a slip fit. This allows the jaw and the pawl to rotate around the sleeves. As noted above, sleeves 44 and 48 are disposed through openings 33 and secured thereto, for example, by staking the sleeves to the housing. The return spring 52 is preferably configured as a torsion coil spring, housed between covers 22 and 25. Spring 52 has a first end 53 that engages jaw 36 and a second end 54 that engages pawl 40. Return spring 52 creates a return force that biases the jaw and pawl toward an open position, as illustrated in FIG. 4.

Referring to FIGS. 4-5, rotary jaw 36 has a strike recess 88 and a notch 100. The strike recess is configured to receive the strike when the jaw is in an open position (FIG. 4), and secure the strike when the jaw is in a closed position (FIG. 5). Notch 100 is configured to engage jaw lock projection 92, which is located on pawl 40. Accordingly, when the jaw lock projection 92 of pawl 40 and notch 100 are engaged (FIG. 5), jaw 36 is prevented from rotating into an open position (FIG. 4). Additionally, notch 100 is configured to engage notch 102, which is located on pawl 40. Notch 102 thus prevents jaw 36 from rotating past an ideal open position.

Figure 6:
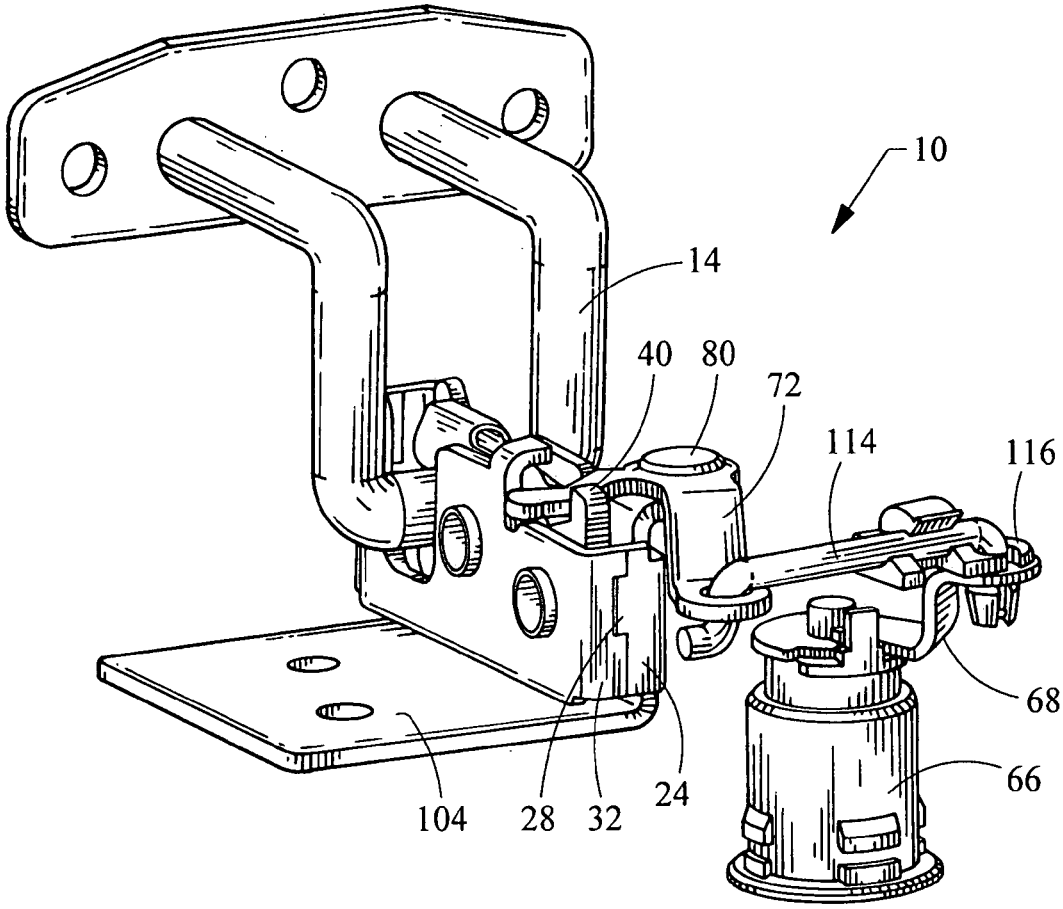
FIG. 6 illustrates a perspective side view of an exemplary latch in a closed position having a linkage assembly.

FIG. 1 illustrates control assembly 65, which includes key lock 66, arm 68 and arm 72. Arm 68 is fixed to lock 66 so that arm 68 swivels as lock 66 is locked and unlocked. As shown in FIG. 6, arm 68 is attached to arm 72 by linkage 114. Snap-fit connector 116 is used to secure linkage 114 to arm 68. Arm 72 has a projection 73 that is configured to engage projection 96 of pawl 36 (FIG. 4). Accordingly, arms 68 and 72 cooperatively link lock 66 to latch assembly 22.

In operation, rotary latch 10 has two main positions-unlatched and latched. FIG. 4 illustrates the unlatched position. When rotary latch 10 is unlatched, jaw 36 extends outwardly relative to housing 18. In particular, strike recess 88 is positioned to receive the strike and rotate into the latched position. FIGS. 1-2 illustrate the latched position. In the latched position, strike 14 is trapped or latched between strike recess 88 and housing assembly 18. To move the rotary latch into a latched position, the strike must be moved into strike recess 88 with sufficient force to overcome the return force created by spring 52. As noted above, when in a latched position, projection 92 of pawl 40 prevents the rotation of jaw 36. A user can release the strike by keying lock 66 into an unlocked position.

The embodiments described above and shown herein are illustrative and not restrictive. The scope of the invention is indicated by the claims rather than by the foregoing description and attached drawings. The invention may be embodied in other specific forms without departing from the spirit of the invention. For example, the housing can be formed from more than two parts, or alternatively as a single, integral structure. Likewise, numerous linkages can be provided between the lock and the latch. In addition, the shape and construction of the associated jaw and pawl structures could be varied while still achieving the required functionality. Likewise, the shape of the strike channel could be varied while still achieving the required functionality. Accordingly, these and other changes which come within the scope of the claims are intended to be embraced herein.

What is claimed is:

1. A rotary latch comprising: a housing comprising a first portion and a second portion, the first portion comprising a first lateral wall and a first transverse wall extending substantially perpendicular from the first lateral wall in a first direction, the first transverse wall having a first terminal edge and defining a first projection extending from the first terminal edge in the first direction, the second portion comprising a second lateral wall spaced apart from the first lateral wall in the first direction so as to form a gap therebetween, and a second transverse wall extending substantially perpendicular from the second lateral wall in a second direction opposite the first direction, the second transverse wall having a second terminal edge and defining a recess extending from the second terminal edge in the first direction, wherein the first projection is received in the recess with the first and second terminal edges abutting such that the first and second transverse walls bridge the gap formed between the first and second lateral walls, and wherein the first projection and the recess are shaped to form a dovetail joint;

a rotary pawl disposed at least partly within the housing between the first and second lateral walls; and a rotary jaw disposed at least partly within the housing between the first and second lateral walls.

2. The rotary latch of claim 1, wherein the first projection forms a tab and the recess forms a slot adapted to receive the tab.

3. The rotary latch of claim 2, further comprising a strike, wherein the first lateral wall and the second lateral wall define a channel shaped to receive the strike.

4. The rotary latch of claim 3, wherein the rotary jaw defines a recess shaped to secure the strike in cooperation with the channel.

5. The rotary latch of claim 4, wherein the housing is formed from a rigid material.

6. The rotary latch of claim 5, wherein the rigid material is steel.

7. The rotary latch of claim 1, wherein the first projection is welded to the recess.

8. The rotary latch of claim 1, further comprising:

a third transverse wall extending substantially perpendicular from the first lateral wall in the first direction, the third transverse wall having a third terminal edge and wherein the third transverse wall is spaced from the first transverse wall in a lateral direction, and a fourth transverse wall extending substantially perpendicular from the second lateral wall in the second direction, the fourth transverse wall having a fourth terminal edge and wherein the fourth transverse wall is spaced from the second transverse wall in the lateral direction, wherein the third and fourth terminal edges are abutting, and wherein one of the third and fourth transverse walls comprises a second projection extending from one of the third and fourth terminal edges; and wherein the other of the third and fourth transverse walls has a second recess defined therein and extending from the other of the third and fourth terminal edges, wherein the second projection is received in the second recess.

9. The rotary latch of claim 1, wherein the first transverse wall is secured to the second transverse wall with an adhesive.

10. A rotary latch comprising:

a housing comprising a first portion, a second portion, and a central region defined therebetween, the first portion comprising a first lateral wall defining a first channel comprising a first mouth opening from a first edge of the first lateral wall in a first direction and a first transverse wall extending from the first lateral wall toward the central region, wherein the first mouth of the first channel does not intersect a plane defined by the first transverse wall, the second portion comprising a second lateral wall defining a second channel comprising a second mouth opening from a first edge of the second lateral wall in the first direction, and a second transverse wall opposed to the first transverse wall and lying in the plane, the second transverse wall extending from the second lateral wall toward the central region, wherein the second mouth of the second channel does not intersect the plane. wherein the first transverse wall is secured to the second transverse wall, wherein the first transverse wall comprises a projection and the second transverse wall comprises a recess shaped to receive the projection, wherein the projection and the recess form a dovetail joint, thereby preventing separation of the first portion relative to the second portion;

a rotary pawl disposed at least partly within the housing;

a unitary rotary jaw having a pair of arms defining a strike recess, said rotary jaw disposed at least partly within the housing; and a strike moveable relative to the housing in the first direction between an engaged position and disengaged position, wherein the first channel of the first lateral wall and the second channel of the second lateral wall are aligned and configured to removeably receive the strike as the strike is moved between the engaged and disengaged positions.

11. The rotary latch of claim 10, wherein the first transverse wall is welded to the second transverse wall, thereby preventing movement of the first transverse wall relative to the second transverse wall.

12. The rotary latch of claim 10, wherein the first transverse wall is secured to the second transverse wall by an adhesive, thereby preventing movement of the first transverse wall relative to the second transverse wall.

* * * * *

UNITED STATES PATENT AND TRADEMARK OFFICE

CERTIFICATE OF CORRECTION

PATENT NO. : 7,267,380 B2
APPLICATION NO. : 10/987222
DATED : September 11, 2007
INVENTOR(S) : Charles Bullock et al.

It is certified that error appears in the above-identified patent and that said Letters Patent is hereby corrected as shown below:

Col. 6 line 14, in claim 10, line 19, immediately after "the plane" delete "." (period) and substitute --,-- (comma) in its place.

Signed and Sealed this

Eighteenth Day of December, 2007

JON W. DUDAS
*Director of the United States Patent and Trademark Office*